US007347144B2

(12) United States Patent
Eisensteger et al.

(10) Patent No.: US 7,347,144 B2
(45) Date of Patent: Mar. 25, 2008

(54) METHOD FOR CARRYING OUT A PRODUCTION CHANGE ON A PRINTING PRESS WITH AUTOMATED CHANGE OF A PRINTING PLATE

(75) Inventors: Thomas Eisensteger, Gersthofen (DE); Martin Endisch, Wertingen (DE); Peter Knauer, Münster/Lech (DE); Josef Singler, Binswangen (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 104 days.

(21) Appl. No.: 11/117,045

(22) Filed: Apr. 27, 2005

(65) Prior Publication Data

US 2007/0022893 A1 Feb. 1, 2007

(30) Foreign Application Priority Data

May 3, 2004 (DE) ..... 10 2004 021 657

(51) Int. Cl.
*B41F 33/16* (2006.01)

(52) U.S. Cl. ..... 101/483; 101/401.1; 101/477

(58) Field of Classification Search ..... None
See application file for complete search history.

(56) References Cited

U.S. PATENT DOCUMENTS

| | | | | |
|---|---|---|---|---|
| 5,479,859 | A * | 1/1996 | Lindner et al. | 101/485 |
| 5,595,119 | A * | 1/1997 | Hada et al. | 101/477 |
| 6,101,944 | A * | 8/2000 | Schmid et al. | 101/467 |
| 6,267,057 | B1 * | 7/2001 | Albert | 101/483 |
| 6,615,725 | B2 * | 9/2003 | Kurata et al. | 101/483 |

* cited by examiner

*Primary Examiner*—Jill E. Culler
(74) *Attorney, Agent, or Firm*—Leydig, Voit & Mayer, Ltd.

(57) ABSTRACT

An automated method is provided for carrying out a production change, which is specific to the printing plate, on a printing press. After a first print job is printed on a printing press, the printing of the first print job is stopped automatically after a predefined print run level has been reached or another termination criterion for the first print job has occurred. Parameters required for printing a second print job which follows the first print job are loaded automatically by the printing press. Before or after the parameters of the second print job are loaded, a printing plate change is automatically carried out on the printing press, thus achieving production readiness for the second print job. The second print job is then either started automatically, or a production readiness signal for the second print job is generated automatically.

4 Claims, 2 Drawing Sheets

METHOD FOR CARRYING OUT A PRODUCTION CHANGE ON A PRINTING PRESS WITH AUTOMATED CHANGE OF A PRINTING PLATE

FIELD OF THE INVENTION

The invention relates to a method for carrying out a production change on a web-fed printing press, and in particular to a production change involving the printing plate of a printing press.

BACKGROUND OF THE INVENTION

During a production change between two different print jobs on a web-fed printing press, complex refitting work or setting-up work has to be carried out on the printing press. For this purpose, according to the prior art, it is always necessary for at least one person, e.g., a printer operator, to intervene manually. In some circumstances, the result is long down times for the printing press between two consecutive print jobs. Furthermore, according to the prior art, the manual intervention by at least one printing operator required for the production change would result in inconsistency in the machine setting, because there are no results which are independent of the operator, and there is therefore no reproducible production change.

SUMMARY OF THE INVENTION

In view of the foregoing, it is an object of the invention to provide a novel method for carrying out a production change, which is specific to the printing plate, on a printing press.

This object is achieved by a method in accordance with the invention for carrying out a production change, which is specific to the printing plate, on a printing press. According to the invention, the method comprises the following steps: a} a first print job is printed on a printing press, the printing of the first print job being stopped automatically after a predefined print run level has been reached or another termination criterion for the first print job has occurred; b) parameters which are required for printing a second print job which follows the first print job are loaded automatically by the printing press; c) before or after the parameters of the second print job are loaded, a printing plate change is automatically carried out on the printing press, in order to thus achieve production readiness for the second print job; d) after production readiness for the second print job has been achieved, the second print job is either started automatically or a production readiness signal for the second print job is generated automatically.

In accordance with a feature of the present invention, the setting-up work or refitting work, which is required for carrying out a production change that is specific to the printing plate on a printing press, is carried out in an automated manner. The invention subdivides the method for carrying out a production change, which is specific to the printing plate, into a plurality of sub-steps which take place one after another and automatically, to attain a production change or results which are independent of the operator and can be reproduced. It is a finding of the present invention that production changes which are specific to the printing plate are suitable, above all, for automatic execution. If, for example, a paper web has to be exchanged or a format change performed during the production change on a web-fed printing press, the method according to the invention is not used in such an operation.

The method according to the invention thus relates exclusively to the automation of production changes on the premise that it is a production change which is specific to the printing plate. An exemplary embodiment of the invention will be explained in greater detail with reference to the drawing, in which:

DETAILED DESCRIPTION OF THE INVENTION

In the following text, the method according to the invention for automatically carrying out a production change, which is specific to the printing plate, on a printing press will be described in greater detail with reference to FIGS. 1 and 2.

Figure 1:
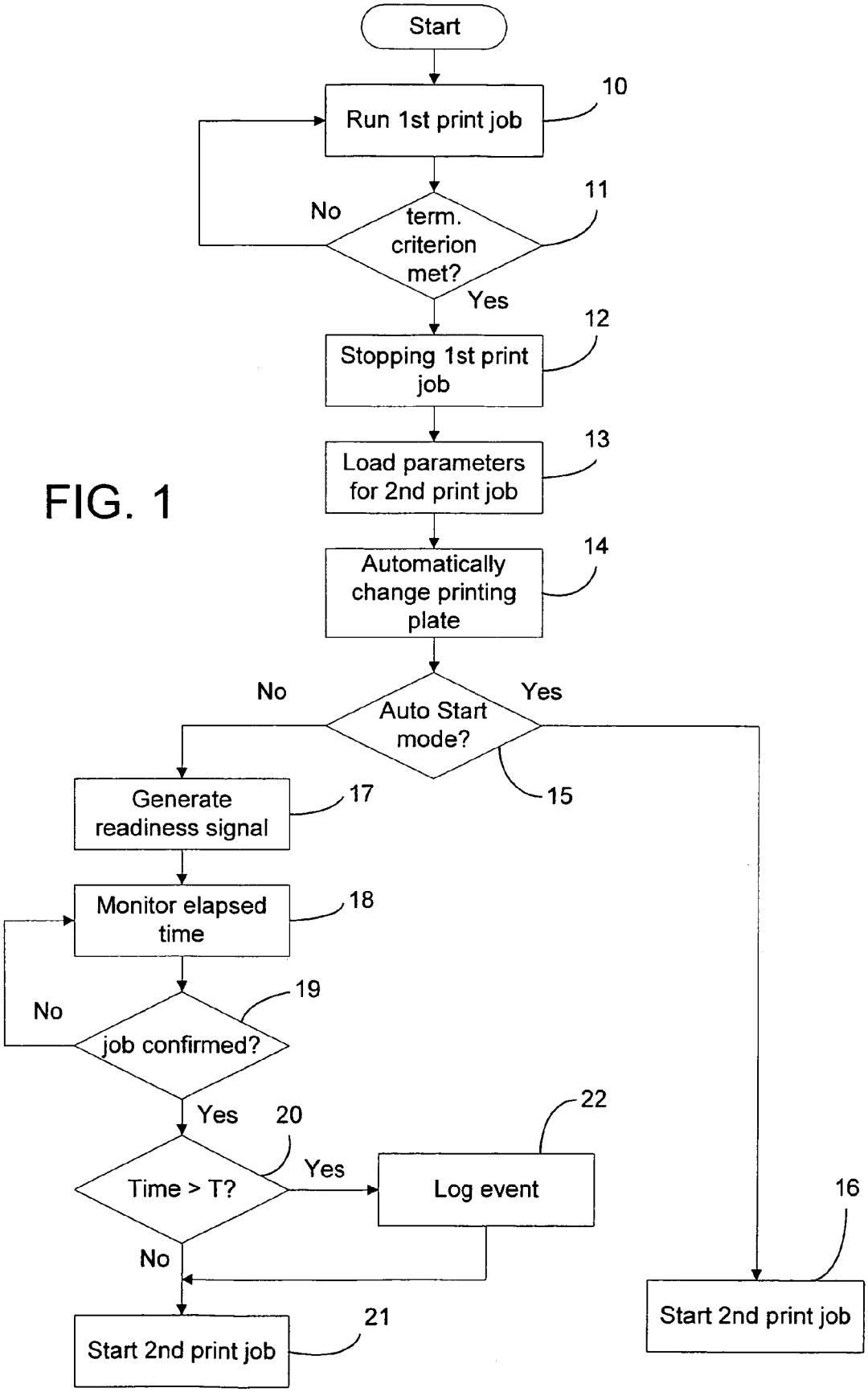
FIG. 1 shows a flowchart of a method according to the invention for carrying out a production change on a printing press that is specific to the printing plate of the printing press.

FIG. 1 illustrates the method according to the invention using a process or signal flowchart. In a first step of the method according to the invention in accordance with block 10, a first print job is printed on a printing press. Within the context of block 11, a check is made continuously during printing of the first print job as to whether there is a termination criterion for the first print job. A termination criterion of this type can be, for example, the reaching of a predefined print run level for the first print job. Furthermore, it can be a termination criterion which is produced by the printer operator. If there is no termination criterion of this type, the program branches back to block 10 and production of the first print job is continued in the context of block 10.

If, in contrast, it is noted in block 11 that, for example, the predefined print run level of the first print job has been reached. If there is thus a termination criterion for the first print job, the program branches off to block 12 of the method according to the invention. In block 12, when a termination criterion for the first print job occurs, the stoppage or termination of the printing of the first print job is automatically initiated or carried out. Here, according to one advantageous development of the invention, inking units of the printing press and/or rubber blankets of the same can be cleaned, for example.

Subsequently, in a further step of the method according to the invention in accordance with block 13, parameters which are required for printing a second print job which follows the first print job are loaded automatically by or into the printing press. These parameters can be parameters which are specific to the print job and/or parameters which are specific to the printing press. Parameters which are specific to the print job are, for example, ink presetting values; parameters which are specific to the printing press are, for example, printing press presetting values. These parameters which are loaded automatically by the printing press are transferred automatically to corresponding actuators or assemblies of the printing press and are then used automatically for the printing of the second print job.

In accordance with a feature of the invention, in a following step of the method according to the invention represented by block 14, a printing plate change is carried out automatically on the printing press. After the parameters have been loaded automatically in accordance with block 13 and a printing plate change has been carried out automatically in accordance with block 14, the operational state known as "production readiness" is present for the second print job. It should be pointed out here that the order of the blocks 13 and 14 can also be reversed, i.e., the automatic printing plate change in accordance with block 14 can take place before the automatic loading of the parameters in accordance with block 13.

When the production readiness for the second print job has been reached, a check is made in accordance with block 15 as to whether the printing press is in the automatic starting mode or not. If the printing press is in the automatic starting mode, the program branches to block 16 starting from block 15 and, immediately after the production readiness in block 14 has been reached, the second print job is then started automatically in the context of block 16.

If, on the other hand, it is detected in block 15 that the printing press is not in the automatic starting mode, the program branches to block 17 starting from block 15 and, in the context of block 17, a production readiness signal for the second print job is generated automatically. This production readiness signal is visualized, for example, in a display or another indication unit of the printing press. When production readiness has been attained and the production readiness signal has been visually annunciated automatically in accordance with block 17, a time monitoring device is activated in accordance with block 18. The time monitoring device monitors and detects the time which has elapsed after the automatic generation of the production readiness signal.

Following the automatic generation of the production readiness signal in accordance with block 17, a continuous check is made in block 19 as to whether there is a print job confirmation or a print job confirmation signal. It thus lies in the scope of the present invention, in the case where the printing press is not in the automatic starting mode, to start the second print job only when, after a production readiness signal has been generated, a print job confirmation has been triggered manually or in some other way. If there is no print job confirmation of this type, the printing of the second print job is not started.

If, however, there is a print job confirmation of this type, the program branches to block 20 starting from block 19 and, in block 20, the time period is detected which has elapsed between the automatic generation of the production readiness signal and the presence of the print job confirmation. In block 20, this time period is compared with a predefined time period or a predefined value. If it is determined during this comparison that the time which has elapsed between the automatic generation of the production readiness signal and the presence of the run confirmation lies below the predefined value, the program branches directly to block 21 starting from block 20 and the production of the second print job is started.

If, in contrast, it is determined in block 20 that the time which has elapsed between the generation of the production readiness signal and the presence of the print job confirmation is greater than the predefined value, the program first branches provisionally to block 22, logging of an event with regard to this being carried out in block 22. Only then is the printing of the second print job started in the exemplary embodiment of FIG. 1, in the context of block 21.

The method described with reference to FIG. 1 for carrying out a production change, which is specific to the printing plate, on a printing press runs almost completely automatically. Only in the case where the printing press is not in the automatic starting mode is an interaction required between block 17 and block 18, namely the presence of a print job confirmation for the second print job. This print job confirmation can be predetermined either manually by the printer operator or by machine from a regulating system or control system of the printing press. In the scope of the present invention, it is thus possible for the print job confirmation to be predetermined by a control system or regulating system of the printing press when, after certain safety criteria have been checked, the presence of the said safety criteria has been determined.

Production change times can be reduced with the aid of the present method according to the invention. Furthermore, the personnel requirement necessary for a production change can be reduced, as the method according to the invention runs in an automated manner.

Figure 2:
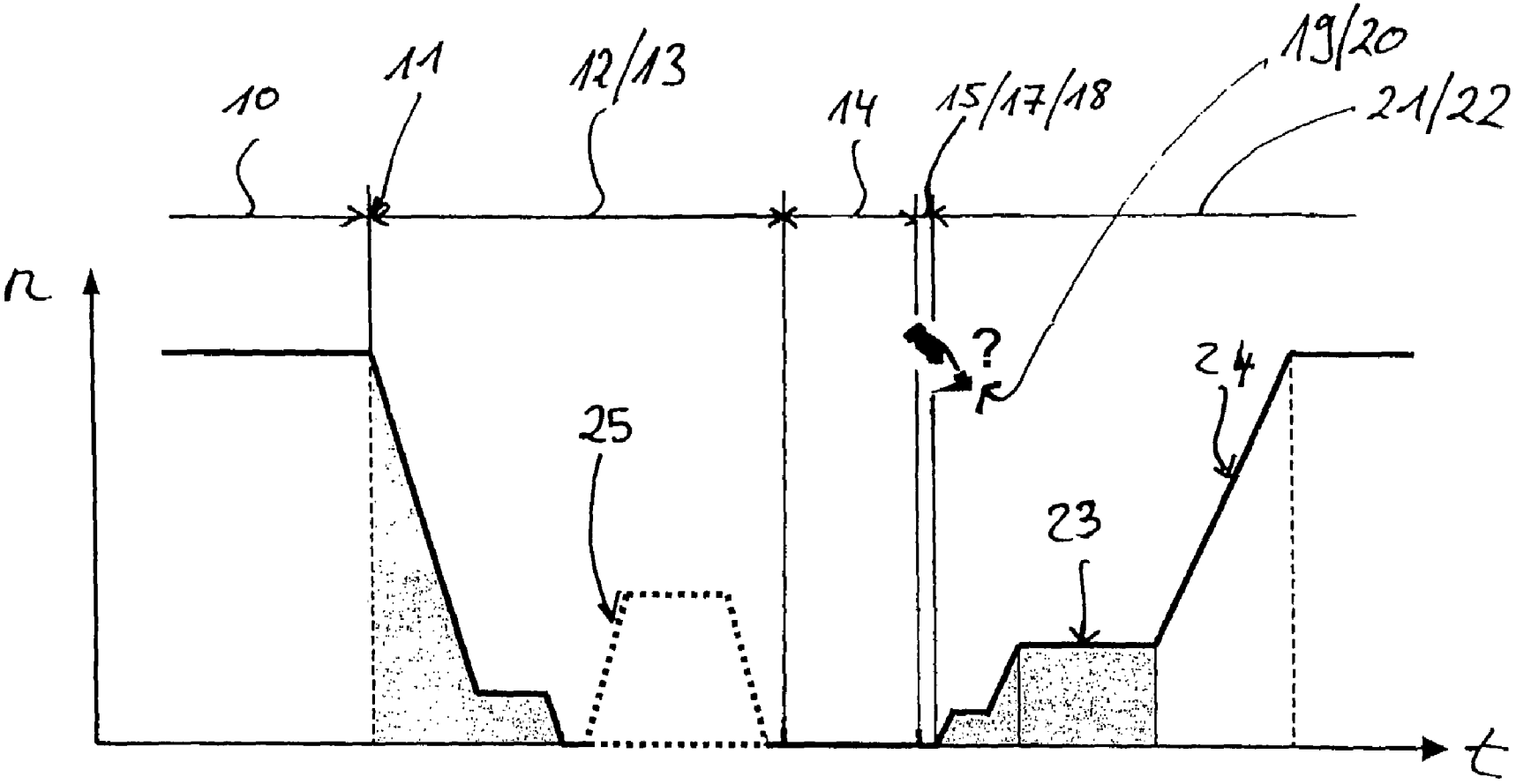
FIG. 2 shows a chart of the machine speed as a function of time during a production change carried out by the method according to the invention, which specific to the printing plate on a printing press.

FIG. 2 illustrates, by way of example, the variation of the speed of the printing press as a function of the time during a process of carrying out the method according to the invention. In FIG. 2, the time t is plotted on the horizontal axis and the speed n of the printing press is plotted on the vertical axis. The time regions which correspond to the blocks 10 to 22 of the signal flowchart of FIG. 1 are indicated by corresponding arrows in the upper region of FIG. 2. These arrows are labelled with reference numerals 10 to 22 which correspond to the blocks 10 to 22.

It can be seen from FIG. 2 that, after a termination criterion for the first print job has occurred (block/arrow 11), the printing press is stopped automatically (block/arrow 12), the speed of the printing press being reduced automatically while the latter is being stopped. Any possible cleaning or washing of the inking units of the printing press or else of the rubber blankets of the same is carried out during the washing phase which is denoted by the reference numeral 25. The printing press is at a standstill during the printing plate change which is carried out automatically (block/arrow 14). After a print job confirmation has occurred (block/arrow 19), the printing press, is started up continuously (block/arrow 21) for the second print job, a setting-up phase which is denoted by the reference numeral 23 and an adjustment phase which is denoted by the reference numeral 24 being run through automatically here, before the printing press runs at full speed and the second print job is processed.

The invention claimed is:

1. A method for carrying out a production change on a printing press specific to a printing plate of the printing press, comprising:

stopping a first print job on the printing press automatically after a predefined print run level has been reached or another termination criterion for the first print job has occurred;

loading automatically by the printing press parameters required for printing a second print job following the first print job;

before or after the parameters of the second print job are loaded, automatically carrying out on the printing press a printing plate change, to achieve production readiness for the second print job;

after production readiness for the second print job has been achieved, automatically generating a production readiness signal for the second print job;

receiving a print job confirmation after the production readiness signal for the second print job is generated;

starting the second print job in response to the print job confirmation; and monitoring a time period between the generation of the production readiness signal and receipt of the print job confirmation.

2. A method according to claim 1, further including the step of automatically cleaning inking units and/or rubber blankets of the printing press in conjunction with the step of stopping the first print job.

3. A method according to claim 1, including loading printing press presetting values and transferring the press presetting values automatically to corresponding actuators or assemblies of the printing press, in conjunction with the step of loading the parameters for the second printing job.

4. A method according to claim 1, further including the step of logging and event when the time period between the generation of the production readiness signal and the print job confirmation exceeds a predefined value.

* * * * *